US012221875B2

(12) United States Patent
Badrinarayanan et al.

(10) Patent No.: US 12,221,875 B2
(45) Date of Patent: Feb. 11, 2025

(54) REAL TIME DRILLING MODEL UPDATES AND PARAMETER RECOMMENDATIONS WITH CALIPER MEASUREMENTS

(71) Applicant: Halliburton Energy Services, Inc., Houston, TX (US)

(72) Inventors: Paravastu Badrinarayanan, Cypress, TX (US); Adnan Zaman, Houston, TX (US); Jeremy Greenwood, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 23 days.

(21) Appl. No.: 17/564,751

(22) Filed: Dec. 29, 2021

(65) Prior Publication Data

US 2023/0203933 A1 Jun. 29, 2023

(51) Int. Cl.

| | |
|---|---|
| ***E21B 44/02*** | (2006.01) |
| ***E21B 7/04*** | (2006.01) |
| ***E21B 47/08*** | (2012.01) |

(52) U.S. Cl.

CPC ..... *E21B 44/02* (2013.01); *E21B 7/04* (2013.01); *E21B 47/08* (2013.01); *E21B 2200/20* (2020.05)

(58) Field of Classification Search

CPC . E21B 44/00; E21B 44/02; E21B 7/04; E21B 47/08; E21B 2200/20

See application file for complete search history.

(56) References Cited

U.S. PATENT DOCUMENTS

| | | | | |
|---|---|---|---|---|
| 4,599,904 | A | 7/1986 | Fontenot | |
| 6,233,524 | B1 * | 5/2001 | Harrell | E21B 44/00 702/9 |
| 6,483,777 | B1 * | 11/2002 | Zeroug | E21B 47/005 367/35 |
| 7,139,689 | B2 * | 11/2006 | Huang | E21B 10/00 702/9 |
| 7,389,828 | B2 | 6/2008 | Ritter et al. | |

(Continued)

FOREIGN PATENT DOCUMENTS

| | | | | |
|---|---|---|---|---|
| AU | 2014332306 | A1 * | 5/2016 | E21B 10/32 |
| CA | 2771036 | A1 * | 8/2007 | E21B 44/00 |

(Continued)

*Primary Examiner* — Jennifer H Gay

(74) *Attorney, Agent, or Firm* — Benjamin Ford; Parker Justiss, P.C.

(57) ABSTRACT

The disclosure recognizes the benefit in determining the dimensions of a wellbore for updating a performance model and changing drilling parameters in real time for steering a drill bit. The disclosed system and method provide improved control for steering a drill bit by obtaining dimension measurements of the wellbore proximate a drill bit and considering the dimension measurements to adjust one or more of the drilling parameters in real time. A method of drilling a wellbore a drilling system, and a drilling tool are disclosed herein. In one example, the method includes: (1) receiving dimension measurements of a wellbore during drilling of the wellbore by a drilling tool, (2) updating an existing performance model of the drilling tool in real time based on the dimension measurements, and (3) operating the drilling tool based on the updated performance model.

21 Claims, 4 Drawing Sheets

(56) References Cited

U.S. PATENT DOCUMENTS 7,413,032 B2 * 8/2008 Krueger ..... E21B 44/005 175/45
7,844,426 B2 * 11/2010 Huang ..... E21B 10/00 703/6
8,185,366 B2 * 5/2012 Huang ..... E21B 44/00 700/98
8,286,729 B2 * 10/2012 Reckmann ..... E21B 7/062 175/45
9,970,266 B2 5/2018 Marx et al.
9,971,058 B2 * 5/2018 San Martin ..... G01V 9/00
9,988,891 B2 * 6/2018 Forstner ..... E21B 7/06
10,024,151 B2 * 7/2018 Dykstra ..... E21B 7/10
10,145,228 B2 * 12/2018 Yarus ..... E21B 47/022
10,329,899 B2 * 6/2019 Zheng ..... E21B 47/022
10,370,902 B2 * 8/2019 Hadi ..... E21B 7/046
10,612,358 B2 * 4/2020 Xue ..... E21B 49/00
11,261,667 B2 * 3/2022 Peters ..... E21B 7/068
11,421,480 B2 * 8/2022 Peters ..... E21B 47/00
11,428,047 B2 * 8/2022 Peters ..... E21B 44/04
11,459,828 B2 * 10/2022 Peters ..... E21B 47/024
2004/0211596 A1 * 10/2004 Huang ..... E21B 44/00 175/38
2004/0216921 A1 * 11/2004 Krueger ..... E21B 44/005 175/24
2005/0080595 A1 * 4/2005 Huang ..... E21B 44/00 702/183
2005/0096847 A1 * 5/2005 Huang ..... E21B 44/00 702/9
2005/0109542 A1 * 5/2005 Downton ..... E21B 17/1014 175/73
2006/0195307 A1 * 8/2006 Huang ..... E21B 44/00 703/7
2007/0185696 A1 * 8/2007 Moran ..... G05B 13/027 703/10
2008/0078242 A1 * 4/2008 Hassan ..... E21B 47/08 73/152.01
2008/0266577 A1 10/2008 Prouvost et al.
2009/0055135 A1 * 2/2009 Tang ..... E21B 47/12 703/7
2009/0065252 A1 * 3/2009 Moos ..... G01V 11/002 175/50
2009/0205867 A1 * 8/2009 Reckmann ..... E21B 47/024 175/45
2010/0211362 A1 * 8/2010 Huang ..... E21B 10/00 703/7
2011/0035200 A1 * 2/2011 Huang ..... E21B 10/00 703/6
2011/0186353 A1 * 8/2011 Turner ..... E21B 44/00 703/2
2016/0032717 A1 2/2016 Parker
2016/0145991 A1 * 5/2016 Yarus ..... E21B 47/022 700/275
2016/0160567 A1 * 6/2016 Downton ..... E21B 44/005 175/73
2016/0281431 A1 * 9/2016 Peters ..... E21B 17/20
2016/0290117 A1 * 10/2016 Dykstra ..... E21B 44/06
2016/0333672 A1 * 11/2016 Klie ..... E21B 44/04
2017/0067333 A1 * 3/2017 Peters ..... E21B 47/00
2017/0074041 A1 * 3/2017 Peters ..... E21B 7/06
2017/0074042 A1 * 3/2017 Peters ..... E21B 47/00
2017/0107808 A1 * 4/2017 Forstner ..... E21B 7/067
2017/0284158 A1 10/2017 Hongbing et al.
2017/0292327 A1 * 10/2017 Reckmann ..... E21B 47/12
2017/0322332 A1 * 11/2017 Cooper ..... G01V 1/40
2018/0017701 A1 * 1/2018 San Martin ..... E21B 44/00
2018/0266181 A1 * 9/2018 Gawski ..... F04C 14/20
2018/0283158 A1 * 10/2018 Hadi ..... E21B 7/046
2019/0032475 A1 * 1/2019 Zheng ..... G01V 1/50
2019/0284908 A1 * 9/2019 Dykstra ..... E21B 44/00
2019/0284921 A1 * 9/2019 Xue ..... E21B 47/024
2020/0011167 A1 * 1/2020 Zhao ..... E21B 44/00
2020/0040657 A1 * 2/2020 Benson ..... E21B 7/04
2020/0355061 A1 * 11/2020 Gharib ..... E21B 47/08
2022/0170359 A1 * 6/2022 Boualleg ..... G06N 20/20
2022/0186603 A1 * 6/2022 Samuel ..... E21B 47/007
2023/0025427 A1 * 1/2023 Li ..... E21B 47/024
2023/0122264 A1 * 4/2023 Ruel ..... G06T 7/73 382/103
2023/0203933 A1 * 6/2023 Badrinarayanan ..... E21B 47/08 175/45
2024/0301784 A1 * 9/2024 Alsultan ..... E21B 17/1021

FOREIGN PATENT DOCUMENTS

CN 107366536 A * 11/2017 ..... E21B 47/08
CN 110720080 A * 1/2020 ..... E21B 10/42
EP 0646697 A1 4/1995
GB 2492911 A * 1/2013 ..... E21B 47/024
WO WO-2005008019 A1 * 1/2005 ..... E21B 10/00

* cited by examiner

300

REAL TIME DRILLING MODEL UPDATES AND PARAMETER RECOMMENDATIONS WITH CALIPER MEASUREMENTS

TECHNICAL FIELD

This disclosure relates, generally, to directional drilling systems and, more specifically, to steering directional drilling systems such as push-the-bit systems.

BACKGROUND

A wellbore is typically used for the recovery of subterranean resources. Planning a drilling job for a wellbore often includes executing models to predict the performance of a drilling tool during a drilling job. Drilling parameters from the pre-job performance models are then used to steer the drilling tool to the desired location according to the well plan for the drilling job. Various types of drilling tools, also referred to as drilling systems, can be used to drill wellbores, such as directional drilling systems. A rotary steerable system (RSS) is an example of drilling system that helps steer the bit in a desired direction. Rotary steerable systems generally come under two categories, push-the-bit and point the bit. There are systems that could be a hybrid of push-the-bit and point-the bit.

For pre-job drilling performance modeling, one factor that is important for a RSS is hole enlargement, i.e. how much bigger is the actual drilled hole compared to a gauge size of the drill bit of the drilling tool. Hole enlargement is an estimated number based on historical knowledge of the formation and performance of similar drilling systems being used in similar formations. In competent subterranean formations hole enlargement can be low, and in soft subterranean formations hole enlargement can be high.

SUMMARY

In one aspect, the disclosure provides a method of drilling a wellbore. In one example the method includes: (1) receiving dimension measurements of a wellbore during drilling of the wellbore by a drilling tool, (2) updating an existing performance model of the drilling tool in real time based on the dimension measurements, and (3) operating the drilling tool based on the updated performance model.

In another aspect, the disclosure provides a drilling system. In one example the drilling system includes: (1) a drilling tool, and (2) a driller controller configured to direct operation of the drilling tool in a wellbore based on real time dimension measurements of the wellbore.

In yet another aspect, the disclosure provides a drilling tool. In one example the drilling tool includes: (1) a drill bit, (2) one or more calipers, and (3) a drilling controller configured to control a direction of the drill bit based on real time dimension measurements obtained by the one or more calipers.

BRIEF DESCRIPTION

Reference is now made to the following descriptions taken in conjunction with the accompanying drawings, in which.

DETAILED DESCRIPTION

Figure 3:
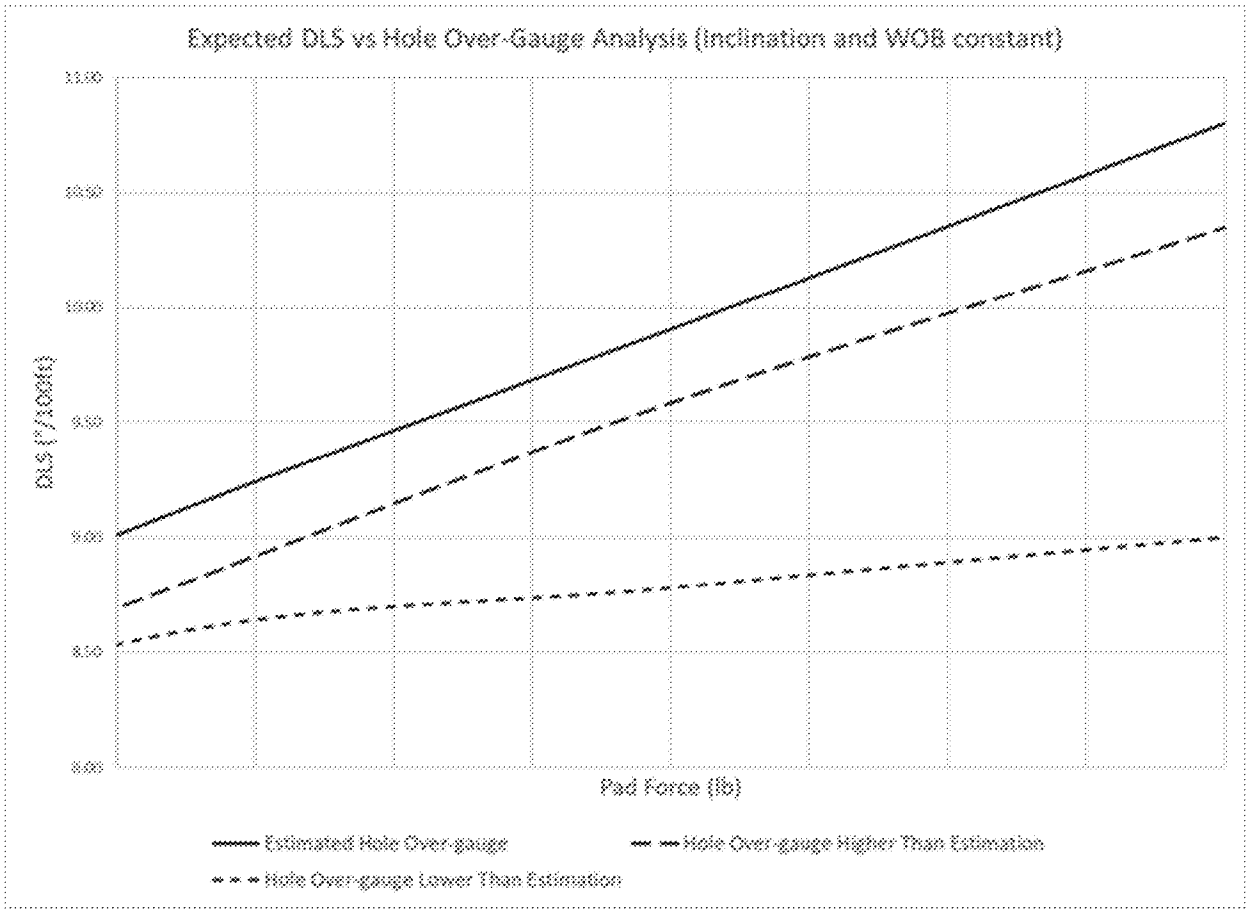
FIG. 3 illustrates a graph showing examples of performance models corresponding to different hole over gauges.
Figure 4A:
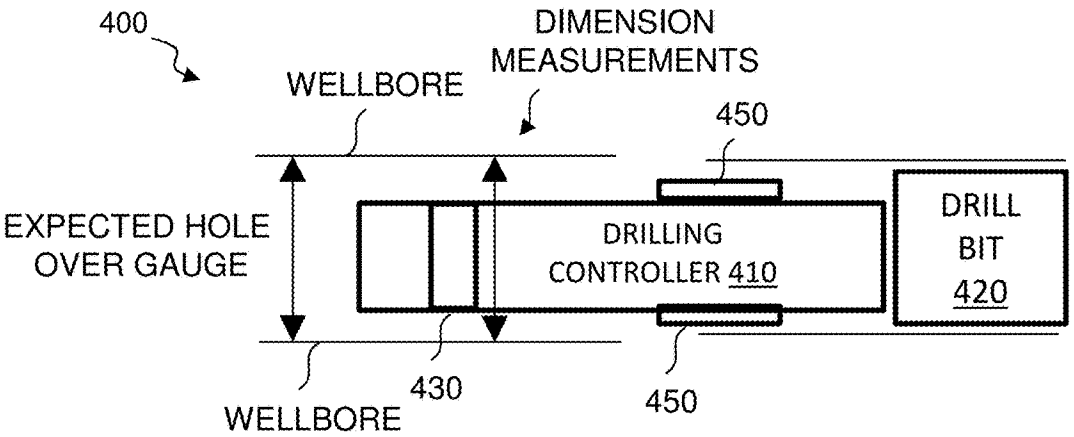
FIGS. 4A and 4B illustrate diagrams of examples of drilling tools operating within wellbores according to the principles of the disclosure.
Figure 4B:
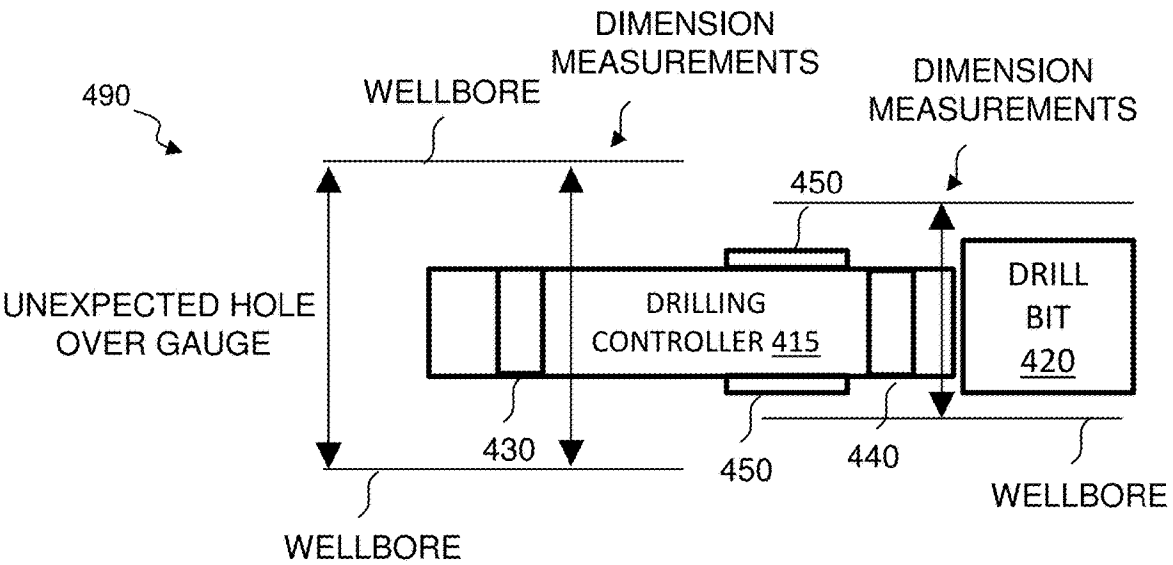

Hole enlargement, also referred to hole over gauge, can be impacted by several factors and can change during a drilling job compared to a pre-planning estimate due to changes in formation, drilling parameters such as flow rates, mud weight, weight on bit, (WOB), etc. As such, using a performance model based on a static hole over gauge during a drilling job can lead to incorrect or suboptimal selection of drilling parameters. For example, a drilling tool can encounter a hole washout during drilling that necessitates updating the drilling parameters to steer the drilling tool to the desired location according to the well plan. When unclear at the surface that there is a hole washout, however, a drilling operator may simply increase the effective steering control or the flow rate to achieve better pad performance, which could be directly counterproductive to what is actually required. Push-the-bit systems have limited pad stroke length available so modifying drilling parameters may not achieve desired results in case of excessive hole washout since pads cannot contact the inside surface of a wellbore. In a different scenario, a hole over gauge that is actually lower than expected can also result in unacceptable performance due to a higher pad force that will lift the drilling tool resulting in contact with the wellbore on the opposite side and cause extensive wear to the tool . FIG. 3 illustrates an example of different performance models based on different hole over gauges. FIGS. 4A and 4B illustrate examples of hole over gauges with respect to a drilling tool.

In another scenario irregular shaped wellbores created by breakout from compressional failure of the wellbore in specific orientations or preferential wellbore collapse in interbedded layers of different strengths can reduce the ability to change hole angle in the orientation of the enlargement. In addition to the orientation of the breakout the depth and size of the breakout around the wellbore has a significant influence. If the required toolface orientation to change the angle of the wellbore aligns with the direction of the breakout and the depth is greater than the distance the pads can extend, the pads will not be able to make contact with the formation removing the ability for the tool to change hole angle. If the depth of the breakout is smaller than the distance the pads can extend or the width of the breakout is less than the width of the pads the directional tendency will be reduced.

The disclosure recognizes the benefit in determining the dimensions of a wellbore for updating a performance model and changing drilling parameters in real time for steering a drill bit. The disclosed system and method provide improved control for steering a drill bit by obtaining dimension measurements of the wellbore proximate a drill bit and considering the dimension measurements to adjust one or more of the drilling parameters in real time. Such dimension measurements correspond to the size and shape of the wellbore of which the effective inner diameter of the wellbore can be a key parameter. The size and shape can vary along the length of the wellbore. The shape can be, for example, an oval, a circle, elongated, irregular, and include a breakout. The dimension measurements can be used to select an updated performance model and use the drilling parameters of the selected updated performance model for steering the drill bit. The dimension measurements can be used to determine a hole over gauge of the wellbore and use the measured hole over gauge to select an updated performance model for operating the drilling tool. The dimension measurements can also be used to determine a measured wellbore breakout orientation and size and use the measured orientation and size of the wellbore breakout to select an updated performance model for operating the drilling tool that ensures pads of the drilling tool contact in gauge hole and a wellbore azimuth is maintained. With a more intelligent selection of drilling parameters, fatigue on tools/electric machines and electronics that control the operation of drilling tools by brute force trial and error can be avoided or at least reduced, and response to real time changes can be faster than that obtained with trial and error The disclosed systems and methods perform dimension measurements and update performance models used for predicting drilling tool performance in real time. Real time as used herein is defined as occurring during the drilling by a drill bit. During the drilling as used herein is when the drill bit is within the wellbore and includes when the drill bit is rotating and when the drill bit is not rotating.

The performance models can be automatically updated and one or more drilling parameters can be automatically adjusted according to the dimension measurements. Updated performance models can be selected throughout the drilling. For instance, as the tool enters a new formation and determines a change in hole size parameters consistently over a few feet of drilling, the drilling models and recommendations can be updated. The drilling parameters include but are not limited to weight on bit (WOB), revolutions per minute (RPM) of a drill bit, flow rate of the drilling mud, and effective steering control. Effective steering control is an operation of pads of a drilling tool to push the drilling tool into a desired direction. For example, pad pusher rotary steerable drilling tools have the ability to vary the effective steering force in a given direction. Some drilling tools do it by varying effective steering control where effective steering control can refer to the steering time at the target toolface (TF) as a percentage of the steering period, which is often referred to as duty cycle. To get maximum steering under a set of conditions, effective steering control will be set to 100%. When less steering is needed, the effective steering control is dropped below 100%. Other rotary steerable tools are able to change the effective steering force but maintain the effective steering direction (target toolface) all the while when the pads are energized by varying the power.

Automatic updates and adjustments can be performed downhole or at the surface of a wellbore. Automatic adjustment of drilling parameters downhole include changing the effective steering control.

The dimension measurements can be determined by one or more calipers associated with the drilling tool. In addition the caliper measurements can be used to generate an image of a wellbore, for example an image log, which will identify the direction and size of one or more wellbore breakouts. A caliper can be, for example, a mechanical caliper or an ultrasonic caliper. The one or more caliper can be part of a bottom hole assembly (BHA). A caliper or calipers can be part of a drilling tool of a BHA. For example, a caliper can be located between pads and a drill bit of the drilling tool.

Figure 1:
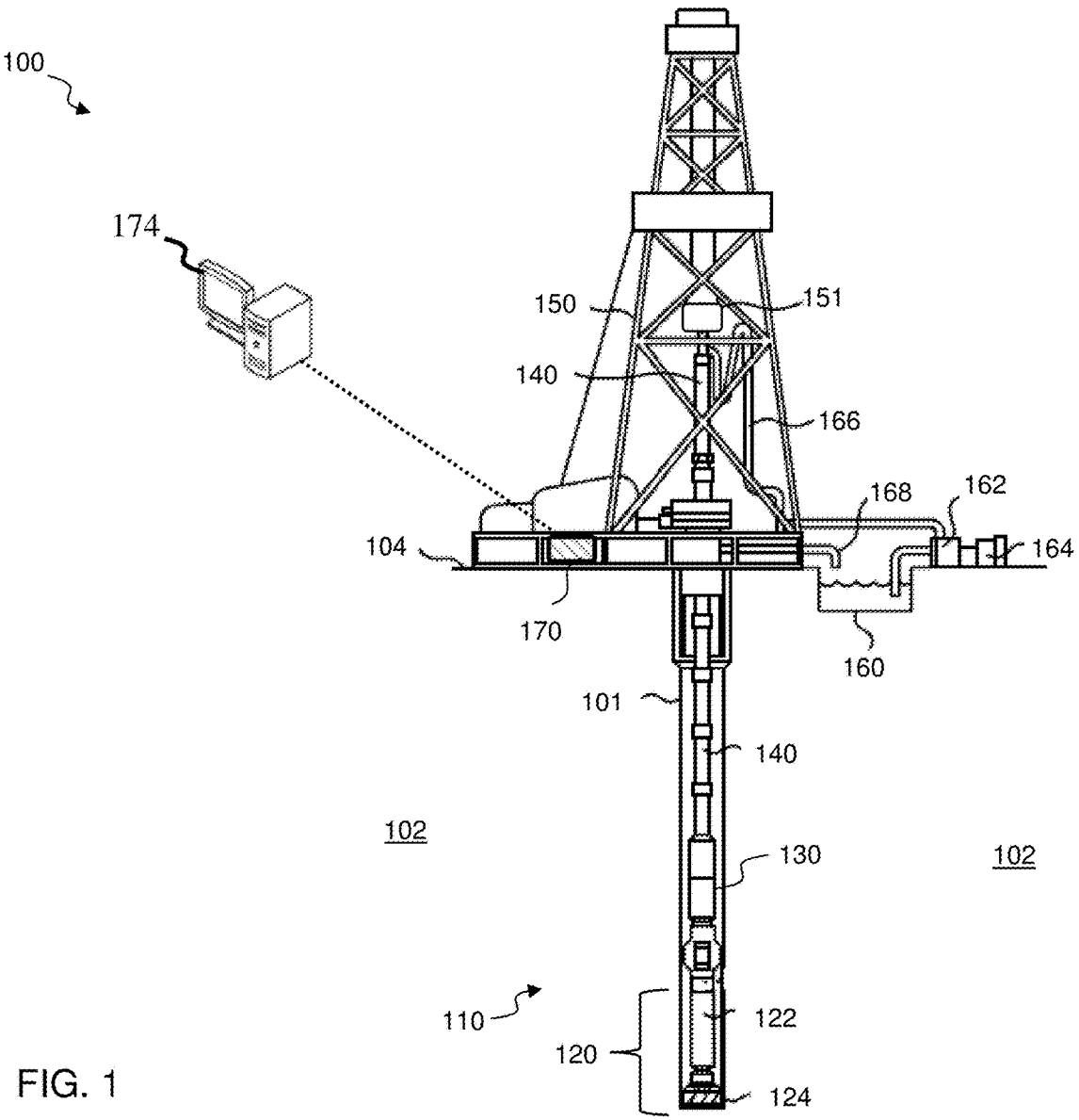
FIG. 1 illustrates a system diagram of an example of a drilling system configured to perform formation drilling to create a wellbore according to the principles of the disclosure.

FIG. 1 illustrates a drilling system 100 configured to perform formation drilling to create a wellbore 101. The system 100 can be, for example, a logging-while-drilling (LWD) system or a measurement-while-drilling (MWD) system. FIG. 1 depicts an onshore operation. Those skilled in the art will understand that the disclosure is equally well suited for use in offshore operations or onshore operations. The system 100 includes a BHA 110 that includes a drilling tool 120 operatively coupled to a tool string 130, which may be moved axially within the wellbore 101. The drilling tool 120 includes a drilling controller 122 and a drill bit 124.

The system 100 is configured to drive the BHA 110 positioned or otherwise arranged at the bottom of a drill string 140 extended into the earth 102 from a derrick 150 arranged at the surface 104. The system 100 includes a top drive 151 that is used to rotate the drill string 140 at the surface 104, which then rotates the drill bit 124 into the earth to thereby create the wellbore 101. Operation of the top drive 151 is controlled by a top drive controller. The system 100 can also include a kelly and a traveling block that is used to lower and raise the kelly and drill string 140.

Fluid or "drilling mud" from a mud tank 160 is pumped downhole using a mud pump 162 powered by an adjacent power source, such as a prime mover or motor 164. The drilling mud is pumped from mud tank 160, through a stand pipe 166, which feeds the drilling mud into drill string 140 and conveys the same to the drill bit 124. The drilling mud exits one or more nozzles arranged in the drill bit 124 and in the process cools the drill bit 124. After exiting the drill bit 124, the mud circulates back to the surface 104 via the annulus defined between the wellbore 101 and the drill string 140, and in the process, returns drill cuttings and debris to the surface 104. The cuttings and mud mixture are passed through a flow line 168 and are processed such that a cleaned mud is returned down hole through the stand pipe 166 once again.

The drilling controller 122 provides directional control of the drill bit 124 as it advances into the earth 102. The drilling tool 120 can be a RSS, such as a push-the-bit drilling tool. For example, the drilling tool 120 can be a drilling tool such as disclosed in FIGS. 4A or 4B. As such, the drilling controller 122 can steer the drill bit by controlling the operation of pads (not shown in FIG. 1) to push off the sidewalls of the wellbore 101. The drilling controller 122 can control the operation of the pads by changing an effective steering control of the pads. The drilling controller 122 can automatically change the effective steering control in real time based on dimension measurements of the wellbore 101 and other parameters. The dimension measurements can be obtained by one or more calipers located downhole. In addition, the drilling controller 122 can use the information derived from image logs that determine a breakout orientation and size and adjusts the direction the pads are extending into to ensure the pads contact with the in gauge wellbore. The drilling controller 122 can also alternate which side of the breakout the pads activate to ensure that the required azimuth of the wellbore 101 is still maintained. One or more calipers can be used to generate the image log. A caliper can be part of the drilling tool 120, part of the tool string 130, or the drilling tool 120 and tool string 130 can each include one or more caliper. The calipers can be conventional calipers that are used downhole. FIGS. 4A and 4B show examples of a drilling tool with calipers.

In addition to a caliper, tool string 130 can be semi-permanently mounted with various measurement tools (not shown) such as, but not limited to, MWD and LWD tools, that may be configured to take downhole measurements of drilling conditions and geological formation of the earth 102. The measurement tools can include sensors, such as magnetometers, accelerometers, gyroscope, etc.

The system 100 also includes a well site controller 170, and a computing system 174, which can be communicatively coupled to well site controller 170. Well site controller 170 includes one or more processors and one or more memory, and is configured to direct operation of the system 100.

Well site controller 170 or computing system 174, can be utilized to communicate with downhole tools of the drilling tool 120 and the tool string 130, such as sending and receiving telemetry, data, drilling sensor data, instructions, and other information, including but not limited to collected or measured parameters, location within the wellbore 101, and cuttings information. Dimension measurements is an example of a measured parameter that can be sent uphole via uplink telemetry and an effective steering control change is an example of an instruction to send downhole with downlink telemetry. A communication channel may be established by using, for example, electrical signals, mud pulse telemetry, or another type of telemetry between the drilling tool 120 and tool string 130 to the well site controller 170.

The controller 170, or a separate computing device such as computing system 174 or a processor located with the BHA 110 can be configured to perform one or more of the functions of a drilling controller as disclosed herein. For example, the controller 170, the computing system 174, or a combination thereof can be configured to determine drilling parameters in real time for operating the drilling tool 120 based on dimension measurements of the wellbore 101.

Computing system 174 can be proximate well site controller 170 or be distant, such as in a cloud environment, a data center, a lab, or a corporate office. Computing system 174 can be a laptop, smartphone, personal digital assistant (PDA), server, desktop computer, cloud computing system, other computing systems, or a combination thereof, that are operable to perform the processes and methods described herein. Well site operators, engineers, and other personnel can send and receive data, instructions, measurements, and other information by various conventional means with computing system 174 or well site controller 170. For example, an existing performance model can be updated at the surface via the computing system 174 or well site controller 170 and instructions can be sent downhole to the drilling controller 122 to change one or more drilling parameters, such as effective steering control, of the drill bit 124. Other drilling parameters, such as flow rate and mud weight, can be determined at the surface and updated at the surface.

Figure 2:
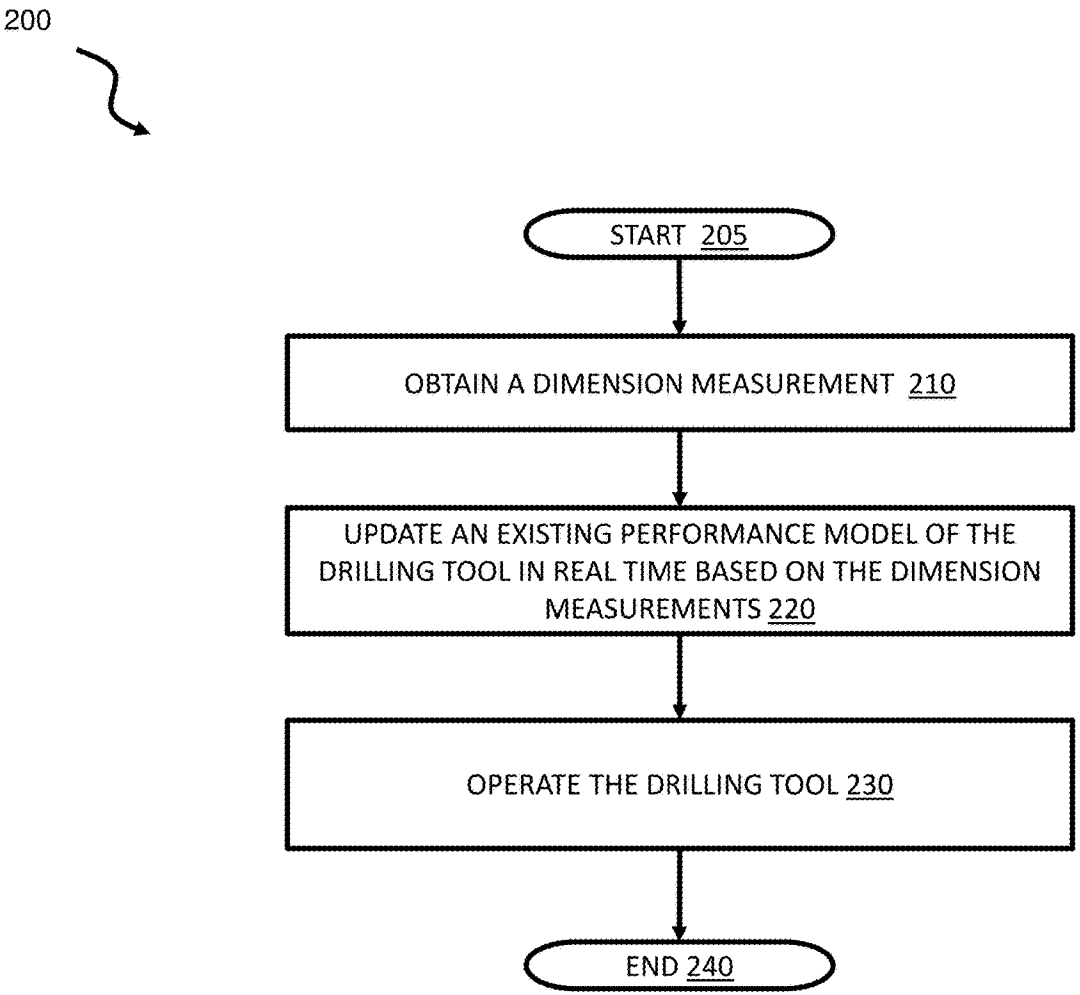
FIG. 2 illustrates a flow diagram of an example of a method of executing a drilling operation carried out according to the principles of the disclosure.

FIG. 2 illustrates a flow diagram of an example of a method 200 of executing a drilling operation carried out according to the principles of the disclosure. The method 200 is carried out in real time and dynamically updates drilling parameters while drilling a wellbore based on dimension measurements of the wellbore. One or more of the steps of method 200 can be performed at the surface of a wellbore or downhole within the wellbore. For example, updating the drilling parameters can be performed at the surface by well controller 170 or computing system 174. A drilling controller located at the surface, downhole, or distributed across both can perform steps of method 200. The drilling controller can include a communications interface for sending and receiving data, one or more processors, and one or more memory to store data and operating instructions to direct operation of the one or more processors to perform the functions of the drilling controller. Determining the updated drilling parameters can be performed at the surface and an instruction or instructions can be transmitted to a drilling controller located downhole for operating a drilling tool. The method 200 can be used with a push-the-bit type of drilling tool. The method 200 begins in a step 205.

In step 210, dimension measurements of a wellbore are obtained during drilling of the wellbore by a drilling tool. The dimension measurements can be obtained from one or more downhole caliper that measures the dimensions of the wellbore during the drilling. The dimension measurements can be transmitted uphole for processing or can be processed downhole.

In step 220, an existing performance model of the drilling tool is updated in real time based on a dimension measurement. The existing performance model can be a pre-planning performance model based on an estimated hole over gauge. The existing performance model can also be a performance model that was previously selected as an updated performance model during drilling. The dimension measurements can be used to determine a measured hole over gauge, which is then used to select an updated performance model. Various performance models for different hole over gauges can be generated during pre-planning, saved, and then selected based on the measured hole over gauge. Dimension measurements can also be used to determine a measured wellbore breakout orientation and size based on the dimension measurements and selecting an updated performance model based on the measured size and orientation of the breakout that ensures the pads contact the sides of the wellbore and the wellbore azimuth is maintained. For example, the toolfaces can be oscillated to ensure the needed build is obtained. The different performance models can be stored, for example, on a memory of a drilling controller.

Updating of the existing performance model can occur at the surface or downhole. When at the surface, one or more instructions can be sent downhole to change at least one of the drilling parameters. The one or more instructions can include the updated drilling parameter or parameters.

The drilling tool is then operated in a step 230 based on the updated performance model. The updated performance model, which is selected using the measured hole over gauge, corresponds to the actual condition of the wellbore at that given time compared to a performance model established during a pre-planning stage of drilling. Drilling parameters from the updated performance model are used to steer the drilling tool. One or more of the drilling parameters can be automatically changed based on the updated performance model. For example, an effective steering control for controlling pads can be automatically changed in real time in response to an updated performance model. Changing of drilling parameters can also be performed manually. For example, suggested drilling parameters based on the updated performance model can be provided to the drilling operator as recommendations. The drilling operator can then change one or more of the drilling parameters based on the recommendations. Whether automatically or manually, the drilling parameters can still be updated in real time. When determined at the surface, one or more of the updated drilling parameters can be sent downhole, such as via an instruction, for operation of the drilling tool. The method 200 then continues to step 240 and ends.

FIG. 3 illustrates a graph 300 showing examples of performance models corresponding to different hole over gauges. Graph 300 highlights the impact of hole size overage on dog leg severity for a given set of conditions. Graph 300 shows max DLS when actual hole over gauge matches the estimation. Graph 300 also shows that tool performance decreases if hole over gauge is higher than estimation since pad force decreases in larger hole size. Similarly, Graph 300 shows that tool performance further decreases if hole over gauge is significantly lower than estimation and results in contact at the pads.

For a drilling job, certain assumption can be made apriori during pre-planning that a given run will be on a performance model, such as the estimated hole over gauge curve as illustrated in FIG. 3, and drilling parameters are appropriately selected. Once drilling in the wellbore, drilling parameters can be fine-tuned by trial and error to meet a required dog leg severity (DLS). However, if a lower DLS is obtained compared to an expected one for a given set of conditions, the lower DLS could be due to a variety of conditions, such as bit wear, formation push, loss of pad force, hole enlargements due to encountering a soft formation, etc. Using a trial and error approach could lead to selecting parameters where a drilling operator makes the situation worse before making it better and varying from the well plan. By obtaining dimension measurements during drilling, solving for the measured hole over gauge using the dimension measurements, and selecting an updated performance model based on the measured hole over gauge, all in real time, can ensure compliance with the well plan.

FIGS. 4A and 4B illustrate diagrams of examples of a drilling tools operating within a wellbore according to the principles of the disclosure. FIG. 4A illustrates drilling tool 400 that includes a drilling controller 410, a drill bit 420, a caliper 430, and pads 450. The drilling controller 410 is configured to control a direction of the drill bit 420 based on real time dimension measurements obtained by caliper 430. For example, the drilling controller 410 can use the dimension measurements to determine a measured hole over gauge of the wellbore. The drilling controller 410 can also use the dimension measurements to determine the orientation and size of a wellbore breakout. The drilling controller 410 can then select an updated performance model for steering the drill bit. The drilling controller 410 can include at least one processor and at least one memory to store the data and operating instructions to direct operation of the at least one processor.

FIG. 4B illustrates a drilling tool 490 that includes a drilling controller 415, a drill bit 420, a first caliper 430, a second caliper 440, and pads 450. The drilling controller 415 is configured to control a direction of the drill bit based on real time dimension measurements obtained by first caliper 430, or second caliper 440, or from both first caliper 430 and second caliper 440. For example, the drilling controller 415 can use an average of caliper measurements from the first and second calipers 430, 440, for a dimension measurement. The dimension measurements obtained from the first and second calipers 430, 440, can differ as shown in FIG. 4B. For example, first caliper 430 can obtain dimension measurements that correspond to the effects of cumulative action of the pads 450 and the drilling bit 420 and second caliper 440 can obtain dimension measurements that correspond to the effects of drilling bit 420 only. Having the different dimension measurements provide additional information that the drilling controller 415 can use to understand the wellbore and steer the drill bit 420. With the dimension measurements, the drilling controller 415 can also determine updates performance models such as described above with respect to drilling controller 410. The drilling controller 415 can include at least one processor and at least one memory to store the data and operating instructions to direct operation of the at least one processor. In FIGS. 4A and 4B, the drilling tools 400 and 490 include one or two calipers. In other examples, a caliper of a tool string, such as tool string 130 of FIG. 1, can be used to obtain dimension measurements.

In FIG. 4A, the expected hole over gauge is the same or is approximately the same as the measured hole over gauge. As such, FIG. 4A illustrates and example where the existing performance model used to obtain drilling parameters most likely does not need to be updated.

FIG. 4B, however, illustrates and example wherein the expected hole over gauge is greater than the measured hole over gauge. As such, incorrect drilling parameters may be used unless a performance model based on the measured hole over gauge is selected as the updated performance model.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of methods and materials are described herein as examples.

Aspects disclosed herein include:

A. A method of drilling a wellbore, including: (1) receiving dimension measurements of a wellbore during drilling of the wellbore by a drilling tool, (2) updating an existing performance model of the drilling tool in real time based on the dimension measurements, and (3) operating the drilling tool based on the updated performance model.

B. A drilling system including: (1) a drilling tool, and (2) a driller controller configured to direct operation of the drilling tool in a wellbore based on real time dimension measurements of the wellbore.

C. A drilling tool, including: (1) a drill bit, (2) one or more calipers, and (3) a drilling controller configured to control a direction of the drill bit based on real time dimension measurements obtained by the one or more calipers.

Each of the disclosed aspects A, B, and C can have one or more of the following additional elements in combination. Element 1: wherein updating the existing performance model includes determining a measured hole over gauge of the wellbore based on the dimension measurements and selecting an updated performance model based on the measured hole over gauge. Element 2: wherein updating the existing performance model includes determining a measured wellbore breakout orientation and size based on the dimension measurements and selecting an updated performance model based on the measured orientation and size of the wellbore breakout that ensures pads of the drilling tool contact in gauge hole and a wellbore azimuth is maintained. Element 3: further comprising obtaining the dimension measurements by measuring during the drilling. Element 4: further comprising transmitting the dimension measurements to the surface of the wellbore. Element 5: wherein the operating includes changing at least one or more drilling parameters of the drilling tool. Element 6: wherein the drilling parameters includes weight on bit, effective steering control, flow rate, and revolutions per minute. Element 7: wherein the updating and changing are automatically performed downhole. Element 8: wherein the updating is performed at the surface of the wellbore and instructions are transmitted downhole for the changing of the at least one or more drilling parameters. Element 9: wherein the driller controller updates a performance model for the drilling tool based on the dimension measurements and directs operation of the drilling tool based on the updated performance model. Element 10: wherein the driller controller determines a measured hole over gauge based on the dimension measurements and updates the performance model based on the measured hole over gauge. Element 11: wherein the driller controller is configured to direct operation of the drilling tool by changing at least one drilling parameter according to the updated performance model. Element 12: wherein the drilling parameter is weight on bit, revolutions per minute, flow rate, or effective steering control. Element 13: wherein the driller controller is configured to automatically change at least one drilling parameter. Element 14: wherein the driller controller is configured to automatically change the at least one drilling parameter downhole. Element 15: wherein the drilling tool is a pad pusher. Element 16: further comprising a set of pads and at least two calipers wherein one of the at least two calipers is located between the drill bit and the set of pads. Element 17: wherein the drilling controller is located proximate the drill bit and includes multiple performance models for the drilling tool, wherein the drilling controller is configured to select an updated performance model from the multiple performance models based on the dimension measurements and automatically control a direction of the drill bit based on the updated performance model. Element 18: further comprising a set of pads, wherein the drilling controller is configured to automatically control a direction of the drill bit by adjusting an effective steering control of the set of pads.

What is claimed is:

1. A method of drilling a wellbore, comprising:

receiving, from at least one caliper associated with a drilling tool, measurements corresponding to a size and shape of a wellbore at a location of the wellbore proximate the drilling tool during drilling of the wellbore by the drilling tool, wherein the drilling tool is a pad pusher and includes pads;

determining a measured wellbore breakout orientation and size based on the size and shape measurements;

identifying a non-uniform hole enlargement from the measured wellbore breakout orientation and size;

updating an existing performance model of the drilling tool in real time by selecting an updated performance model based on the non-uniform hole enlargement; and operating the drilling tool by controlling the pads based on the updated performance model, wherein controlling the pads includes orienting the pads to contact the wellbore and maintain one or more of a required wellbore azimuth or wellbore inclination.

2. The method as recited in claim 1, wherein updating the existing performance model includes determining a measured hole over gauge of the wellbore based on the size and shape measurements and selecting an updated performance model based on the measured hole over gauge and shape.

3. The method as recited in claim 1, further comprising obtaining the size and shape measurements in real time along a length of the wellbore by measuring during the drilling of the wellbore.

4. The method as recited in claim 1, further comprising transmitting the size and shape measurements to the surface of the wellbore.

5. The method as recited in claim 1, wherein the operating includes changing at least one or more drilling parameters of the drilling tool.

6. The method as recited in claim 5, wherein the drilling parameters include at least one of flow rate and revolutions per minute.

7. The method as recited in claim 5, wherein the drilling parameters include at least one of weight on bit and effective steering control.

8. The method as recited in claim 5, wherein the updating and changing are automatically performed downhole.

9. The method as recited in claim 5, wherein the updating is performed at the surface of the wellbore and instructions are transmitted downhole for the changing of the at least one or more drilling parameters.

10. A drilling system for use with a wellbore, comprising:

a drilling tool having at least one measurement tool and at least one pad; and a driller controller configured to update a performance model for the drilling tool based on a non-uniform hole enlargement identified by size and shape measurements of the wellbore and direct operation of the drilling tool in the wellbore based on the updated performance model by controlling the at least one pad, wherein the size and shape measurements are real time size and shape measurements of the wellbore, obtained from the at least one measurement tool, along a length of the wellbore at locations proximate the drilling tool during drilling of the wellbore by the drilling tool, wherein the controlling includes orienting the at least one pad to contact the wellbore and maintain one or more of a required wellbore azimuth or wellbore inclination.

11. The drilling system as recited in claim 10, wherein the driller controller determines a measured hole over gauge based on the size and shape measurements and updates the performance model based on the measured hole over gauge and shape.

12. The drilling system as recited in claim 10, wherein the driller controller is configured to direct operation of the drilling tool by changing at least one drilling parameter according to the updated performance model.

13. The drilling system as recited in claim 12, wherein the drilling parameter is effective steering control.

14. The drilling system as recited in claim 12, wherein the drilling parameter is weight on bit.

15. The drilling system as recited in claim 12, wherein the drilling parameter is revolutions per minute or flow rate.

16. The drilling system as recited in claim 10, wherein the driller controller is configured to automatically change at least one drilling parameter.

17. The drilling system as recited in claim 16, wherein the driller controller is configured to automatically change the at least one drilling parameter downhole.

18. A drilling tool, comprising:

a drill bit;

at least two calipers;

a set of pads, wherein one of the at least two calipers is located between the drill bit and the set of pads; and a drilling controller configured to control a direction of the drill bit based on real time size and shape measurements obtained by one or more of the at least two calipers.

19. The drilling tool as recited in claim 18, wherein the drilling tool is a pad pusher.

20. The drilling tool as recited in claim 18, wherein the drilling controller is located proximate the drill bit and includes multiple performance models for the drilling tool, wherein the drilling controller is configured to select an updated performance model from the multiple performance models based on the size and shape measurements and automatically control a direction of the drill bit based on the updated performance model.

21. The drilling tool as recited in claim 18, wherein the drilling controller is configured to automatically control a direction of the drill bit by adjusting an effective steering control of the set of pads.

* * * * *